US005876225A

United States Patent [19]

Katsuma et al.

[11] Patent Number: 5,876,225

[45] Date of Patent: Mar. 2, 1999

[54] LEVER TYPE CONNECTOR

[75] Inventors: Takatoshi Katsuma; Shinichi Yamada; Hirotaka Makino, all of Mie, Japan

[73] Assignee: Sumitomo Wiring Systems, Ltd., Japan

[21] Appl. No.: 801,143

[22] Filed: Feb. 18, 1997

[30] Foreign Application Priority Data

Feb. 15, 1996 [JP] Japan ..... 8-027802

[51] Int. Cl.[6] ..... H01R 13/62

[52] U.S. Cl. ..... 439/157

[58] Field of Search ..... 439/152–160, 439/341, 372

[56] References Cited

U.S. PATENT DOCUMENTS

| | | | |
|---|---|---|---|
| 5,135,408 | 8/1992 | Suzuki | 439/310 |
| 5,230,635 | 7/1993 | Takenouchi et al. | 439/157 |
| 5,322,383 | 6/1994 | Saito et al. | 439/157 |
| 5,427,539 | 6/1995 | Saito | 439/157 |
| 5,476,390 | 12/1995 | Taguchi et al. | 439/157 |

FOREIGN PATENT DOCUMENTS 6-275337 9/1994 Japan .

*Primary Examiner*—Khiem Nguyen
*Assistant Examiner*—Eugene G. Byrd
*Attorney, Agent, or Firm*—Banner & Witcoff, Ltd.

[57] ABSTRACT

A lever connector assembly has a stopping projection 35, which serves to hold a lever 30 in an initial position, and is located in such a position that it is distant from a trace described by a cam pin 12 as the cam pin 12 is inserted into a cam groove 34. When connectors 10 and 20 are in an initial fitting state, the cam pin 12 is inserted into the cam groove 34. Pivoting of the lever 30 results in a pressing member 13 engaging the stopping projection 35 and moving it outwards, to separate from the fitting groove 24. The amount of movement of the projection 35 is reduced compared with the prior art, and as a consequence frictional resistance to movement is lower.

20 Claims, 6 Drawing Sheets

LEVER TYPE CONNECTOR

TECHNICAL FIELD

The present invention relates to a lever-type electrical connector wherein corresponding connector housings fit together by means of a rotative operation of a lever.

BACKGROUND OF THE INVENTION

A lever-type connector has a lever provided on one of two connector housings and has cam pins provided on the other connector housing, the cam pins fitting with cam grooves provided on the lever. The two connector housings are brought close to each other and the cam pins are located in the cam grooves. Then, the lever is pivoted and the connector housings are thereby brought even closer to each other, bringing them to a correctly fitted state. In this kind of connector, it is necessary to maintain the lever in an initial position in order to be able to locate the cam pins correctly into the cam grooves.

The means disclosed in Laid Open Publication JP6-275337 is one way of maintaining the lever in the initial position. As shown in FIG. 17 and FIG. 18 of this specification, a lever 1 has elastically bendable stopping projections 2 formed thereon. These stopping projections 2 pass into cam pin grooves 4 of a connector housing 3, thereby preventing movement of the lever 1 in the initial position. Further, as shown in FIG. 19, when the two connector housings 3 and 5 are fitted together, cam pins 6 enter cam grooves 7 and make contact with the stopping projections 2, thereby pushing out the stopping projections 2 from the cam pin grooves 4. As a result, the lever 1 becomes movable and can be pivoted to the closed condition.

In the conventional case, cam pins 6 are made to protrude deeply into the cam grooves 7 so as to serve as members for removing the stopping projections from the cam pin grooves 4. As a result, as shown in FIG. 19, the stopping projections 2 must bend very considerably and the opposing force generated due to the elastic recovery force of the stopping projection 2 is consequently large. This results in a deterioration of operability during the fitting of the connector housing and during the movement of the lever as a consequence of the friction forces.

The present invention has been developed after taking the above problem into account, and aims at limiting the bending of the stopping projections to the minimum necessary extent at the point when the lever becomes pivotable.

STATEMENT OF THE INVENTION

According to the invention there is provided a lever-type electrical connector assembly comprising a male housing, a female housing, opposite cam pins protruding from one of said housings and a lever pivotable on the other of said housings, the lever having opposite cam grooves for engagement with said cam pins whereby pivoting of said lever from an initial to a final position cause said housings to be drawn together in use, a stopping projection being provided on one of the other of said housings and said lever to restrict pivoting movement of said lever from the initial position, said stopping projection being spaced from the path of movement of said cam pins in use, and a pressing member being provided on said one of said housings, the pressing member being engageable with said stopping projection on initial coupling of said housings to urge said projection to a condition whereby pivoting of said lever is not restricted.

In a preferred embodiment, the pressing member has a guide face provided for camming engagement with the stopping projection, such that on camming engagement of the guide face with the stopping projection the stopping projection is urged to a condition whereby pivoting of said lever is not restricted.

Preferably, the stopping projection is formed on the lever and fitting grooves are defined in said other of said housings, the fitting grooves being suitable to accommodate the cam pins of said one of said housings, wherein in the initial position the stopping projection is engageable in one of the fitting grooves to restrict pivotal movement of said lever, and the pressing member is engageable in said one fitting groove with the stopping projection to urge the stopping projection out of engagement in the fitting groove. In that case, the pressing member is preferably substantially the same width as said one of the fitting grooves, the corresponding cam pin being substantially narrower than said fitting groove; the pressing member may be flush with the exterior of said other of said housings when the asembly is in an assembled state.

In a preferred embodiment, the pressing member projects from said housing to a lesser extent than the cam pins.

The stopping projection may be located in the lever sufficiently close to the pivot axis of the lever as to be enclosed between the lever and said other of said housings throughout the sweep of the lever relative said housing. The stopping projection may be a lug projecting from the internal surface of the lever towards said other of said housings, the lever being resilient.

Alternatively, the stopping projection may comprise a resilient arm of the lever, the resilient arm having a portion projecting inwardly towards said other of said housings.

BRIEF DESCRIPTION OF DRAWINGS

Other features of the invention will be apparent from the following description of several preferred embodiments shown by way of example only in the accompanying drawings in which.

Figure 1:
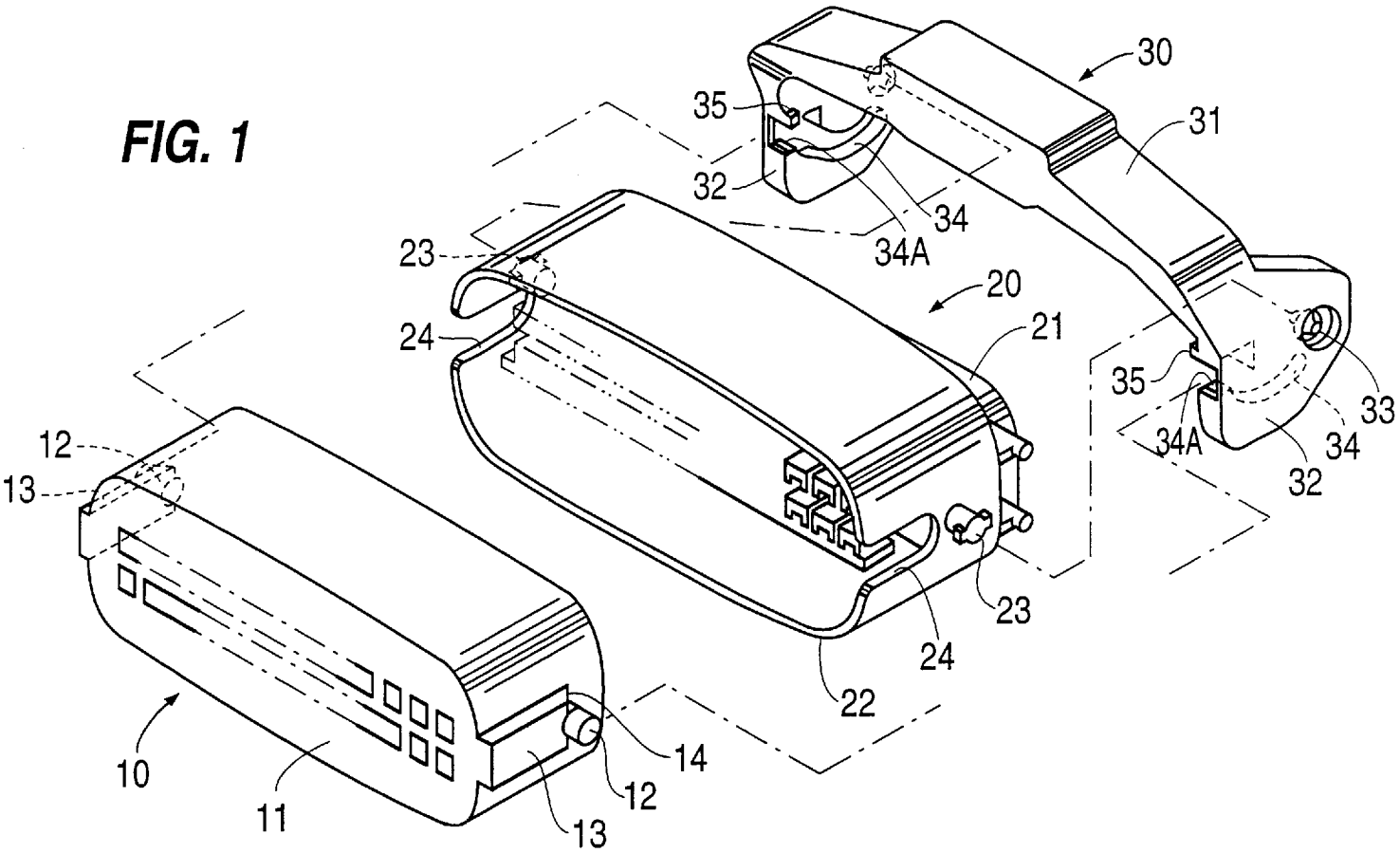
FIG. 1 is a diagonal view of embodiment 1 showing connectors and a lever in a separated state.

Embodiment 1 of the present invention is described with reference to FIGS. 1 to 8.

A lever-type connector relating to the present embodiment comprises a male connector 10, a female connector 20 and a lever 30.

The female connector 20 comprises a connector housing 21 having a hood member 22 formed in a unified manner thereon and protruding anteriorly so as to face the male connector 10. Both the side faces of the connector housing 21 have mutually coaxial supporting axles 23 projecting therefrom. As described later, the lever 30 is attached to these supporting axles 23 so as to be pivotable. Both the side faces of the connector housing 21 have fitting grooves 24 formed therein so as to open towards the anterior edge of the hood 22. These fitting grooves 24 are in a direction corresponding to the fitting direction of the male connector 10. The upper groove edges of the fitting grooves 24 shown in FIG. 1 to 6 are arranged to allow stopping projections 35 to fit therewith, the stopping projections 35 serving to maintain the lever 30 at a specified initial position. Moreover, the fitting grooves 24 also serve as grooves for preventing abutment between cam pins 12 of the male connector 10 and the hood 22 during the fitting of the connectors 10 and 20.

The lever 30 comprises an operating member 31 parallel to the axis of the axles 23, and a pair of planar arms 32 formed on both ends. The arms 32 have axial through holes 33 so as to accommodate the axles 23. Furthermore, the inner faces of the arms 32 have spiral cam grooves 34 formed therein which fit with cam pins 12 of the connector 10, to be described later. The width-wise dimension of the cam grooves 34 is set to be smaller than width-wise dimension of the fitting groove 24; furthermore, the cam groove 34 and the fitting groove 24 are located so that the central line of the one corresponds with that of the other in the initial position of the lever 30.

Figure 3:
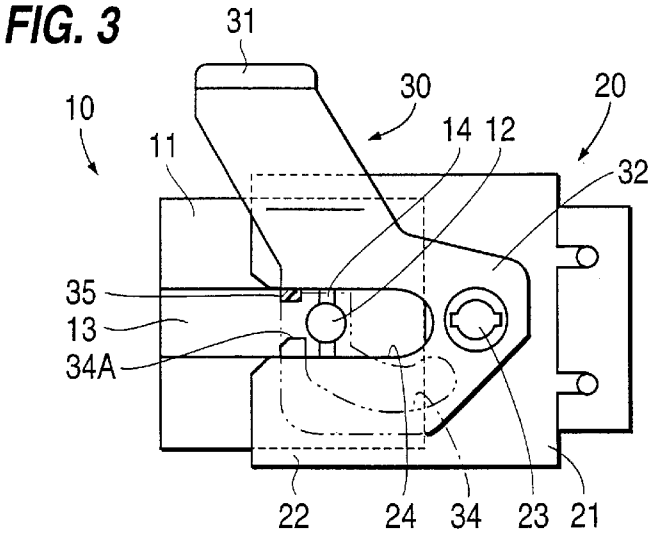
FIG. 3 is a side view of embodiment 1 showing a state whereby the cam pin is inserted in the cam groove.
Figure 4:
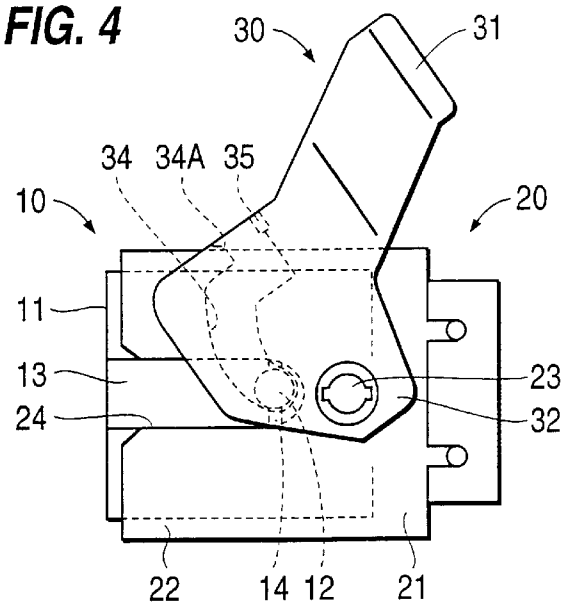
FIG. 4 is a side view of embodiment 1 showing a state whereby the connectors are fitted together in the correctly fitted position due to the pivoting of the lever.

The lever 30 is pivotable between the initial position, (see FIGS. 2 and 3), and the final position, which is the position achieved after the fitting of the connectors 10 and 20 has been completed (see FIG. 4). In the initial position, openings 34A located at one end of the cam groove 34 are positioned so as to face the male connector 10 and thus be able to receive the cam pins 12. The lever 30 has stopping projections 35 for maintaining the lever 30 in the initial position when the connectors 10 and 20 are separated. This stopping projection 35 are formed so as to project inwards from one of the groove edges (located on the upper side in FIGS. 2 to 4) of the opening 34A. In the initial position, the projections 35 fit with the edge of the fitting groove 24 from the external side. The lever 30 is thus maintained in a position whereby it cannot be pivoted in a direction that is clockwise in FIGS. 2 to 4.

Figure 2:
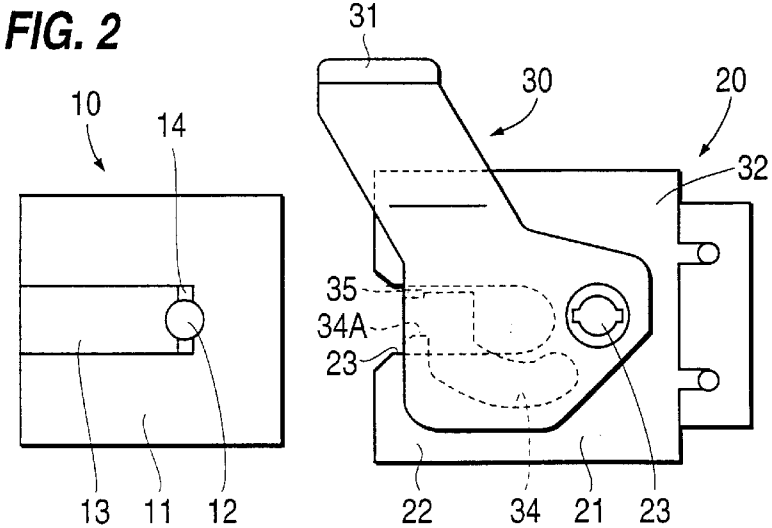
FIG. 2 is a side view of embodiment 1 showing both the connectors in a separated state.

The stopping projection 35 is located towards the upper side in FIGS. 2 to 4 so as to be relatively distant from the trace described by the cam pin 12 when it is inserted into the cam groove 34. Consequently, there is no possibility of the stopping projection 35 interfering with the cam pin 12.

The male connector 10 comprises a connector housing 11 (constituting an element of the present invention), and a pair of cam pins 12 formed so as to project from both the side faces of the connector housing 11. These cam pins 12 fit with the cam groove 34, thereby forcibly pulling the connectors 10 and 20 from their initial fitting position to the final fitted position as the lever 30 is pivoted.

Both the side faces of the connector housing 11 have pressing members 13 provided independently of the cam pins 12, these pressing members 13 serving to release engagement of the stopping projection 35 with the fitting groove 24. The pressing members 13 are formed above and below the cam pin 12 shown in FIGS. 2 to 4, and form a flat rectangular shape so that there is an approximately tight fit in the fitting groove 24 during the fitting of the connectors 10 and 20.

An extreme end of the pressing member 13 is partly connected to the base of the cam pin 12. Both sides of this connected portion have guiding faces 14 located at an angle with respect to the fitting direction of the female connector 20.

The height of the pressing member 13 from the connector housing 11 is less than that of the cam pin 12 and is set to coincide with the external face of the hood 22 when it is fitted into the fitting groove 24.

The upper and lower ends of the pressing member 13 shown in FIG. 2 to 4 enter into the fitting groove 24 when the connectors 10 and 20 are fitted together, by moving within the external range of the trace described by the cam pin 12 during its insertion into the cam groove 34. This pressing member 13, which has been inserted into the fitting groove 24, presses the stopping projection 35 of the lever 30 outwards by abutment from its inner side, so that the stopping projection 35 is removed from contact with the edge of the fitting groove 24.

Next, the operation of the embodiment is described.

Figure 7:
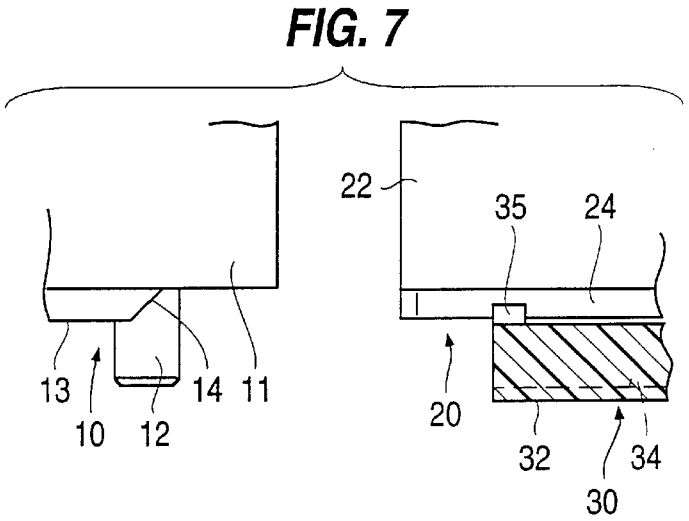
FIG. 7 is a partially enlarged cross-sectional view of embodiment I showing a state whereby the stopping projection fits with the fitting groove and the lever is prevented from rotating.
Figure 5:
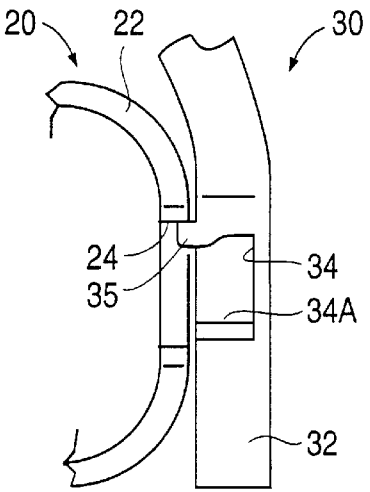
FIG. 5 is a partially enlarged front view of embodiment 1 showing a state whereby the stopping projection fits with the fitting groove, thereby preventing the lever from being rotated.

When the connectors 10 and 20 are not yet fitted together, as shown in FIGS. 2, 5 and 7, since the stopping projection 35 fits with the edge of the fitting groove 24, the lever 30 is maintained in the initial position, this position permitting the insertion of the cam pin 12 into the cam groove 34.

Figure 8:
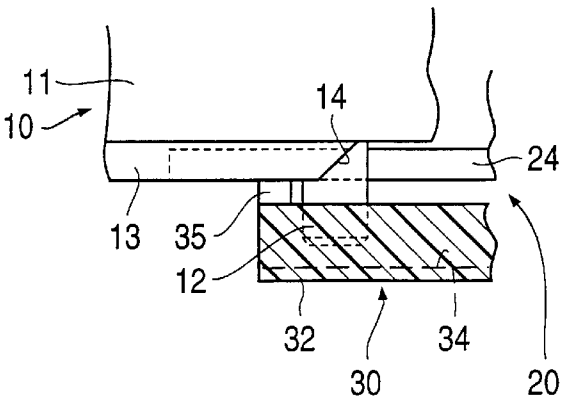
FIG. 8 is a partially enlarged cross-sectional view of embodiment 1 showing a state whereby the stopping projection separates from the fitting groove and the lever becomes rotatable again.
Figure 6:
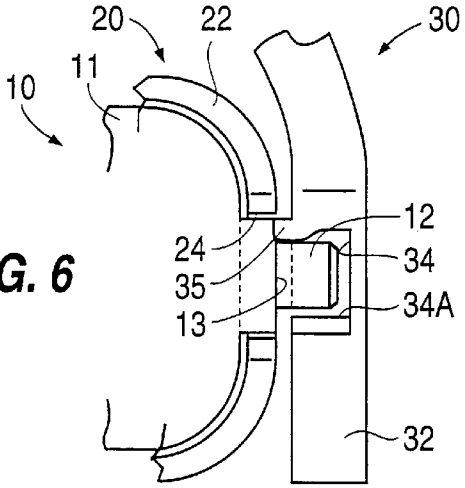
FIG. 6 is a partially enlarged front view of embodiment 1 showing a state whereby the stopping projection separates, thereby making the rotation of the lever possible again.

When the male connector 10 is fitted into the hood 22, the cam pin 12 locates in the cam groove 34. Along with this, the pressing member 13 enters the fitting groove 24, and the guiding face 14 located on its anterior end makes contact with the stopping projection 35. The stopping projection 35 bends outwards gradually in accordance with the incline of the guiding face 14, and comes to rest on the outer face of the pressing member 13. At this point, along with the change of position of the stopping projection 35, the attachment members 32 located on the two ends of the lever 30 bend elastically so as to widen outwards. In this way, the stopping projection 35 is pushed outwards by means of the pressing member 13, and as shown in FIGS. 6 to 8, the stopping projection 35 is separated from the fitting groove 24, thereby allowing the lever 30 to pivot.

When the movement of the lever 30 becomes possible in this manner, the lever 30 can be pivoted in a clock-wise direction from the initial position. Due to the cam effect of the cam pin 12 and the cam groove 34 the male connector 10 is pulled towards the female connector 20, and, as shown in FIG. 4, the connectors 10 and 20 reach the final fitted position, thereby completing the fitting operation.

As described above, in the present embodiment, the stopping projection 35, which serves to maintain the lever 30 in the initial position by preventing it from rotating, is located in a position distant from the trace described by the cam pin 12 when it is inserted into the cam groove 34. Moreover, the pressing member 13, which serves to move the stopping projection 35 in such a direction as to make the rotation of the lever 30 possible again, is provided independently of the cam pin 12. The pressing member 13 is formed at a height that is lower than that of the cam pin 12, so as to fit with the stopping projection 35 along the exterior portion of the cam groove 34. With the configuration as described above, the amount of movement of the stopping projection 35 is kept small as compared with the prior art. Consequently, the elastic recovery force resulting from the bending of the lever 30 is small, and when the lever 30 is pivoted the frictional resistance caused by the elastic recovery force of the lever 30 is also relatively small. This results in superior operability.

Moreover, although the timing of the completion of insertion of the cam pin 12 into the cam groove 34 and the timing of the release of the rotation lock by the pressing member 13 are decided by the mutual relative positions of the cam pin 12, the pressing member 13 and the stopping projection 35, since in the present embodiment the pressing member 13 is provided independently of the cam pin 12, the degree of freedom of the setting of the timing in both cases increases.

Furthermore, in the present embodiment 1, the stopping projection 35 and the pressing member 13 are prevented from getting stuck during fitting by forming the guiding face 14 on the anterior end of the pressing member 13. Accordingly, operability is prevented from deteriorating during fitting.

In the present embodiment it is arranged so that a groove or a large gap between the external face of the pressing member 13 and the external face of the hood member 22 does not occur; this is effected by making the external face of the pressing member 13 and the external face of the hood member 22 coincide, and by making the pressing member 13 fit snugly in the fitting groove 24. Consequently, when, along with the pivoting of the lever 30, the stopping projection 35 passes between the external face of the pressing member 13 and the external face of the hood member 22, the operating resistance does not change much. As a result, superior operability is achieved.

Moreover, in the present embodiment, since the fitting groove 24 also serves as a groove for preventing a collision between the cam pin 12 and the hood 22, compared to the case where these grooves are provided separately, the amount of cutting into the hood 22 is reduced, and the reduction in strength of the hood 22 due to extensive slotting is moderated.

Figure 9:
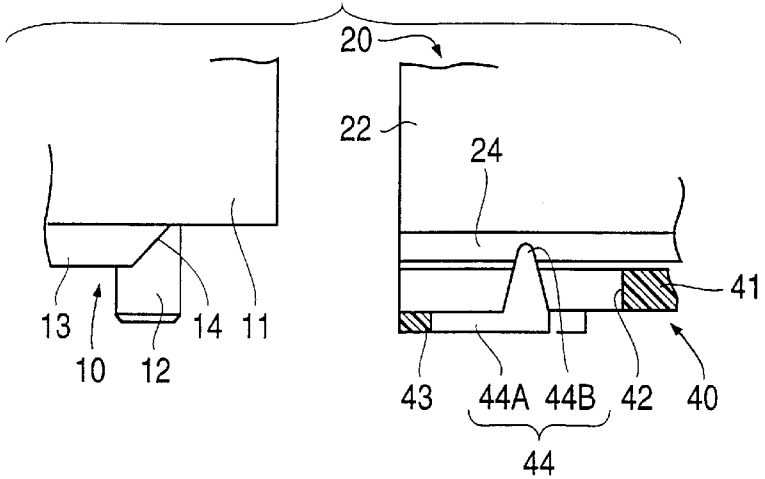
FIG. 9 is a partially enlarged cross-sectional view of embodiment 2 showing a state whereby the stopping projection fits with the fitting groove and the lever is prevented from rotating.
Figure 10:
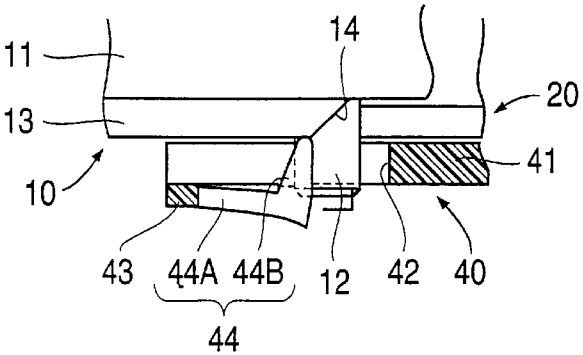
FIG. 10 is a partially enlarged cross-sectional view of embodiment 2 showing a state whereby the stopping projection separates from the fitting groove and the lever becomes rotatable again.

Next, embodiment 2 of the present invention is described, with reference to FIGS. 9 to 10.

This embodiment differs from embodiment 1 with respect to the configuration of the stopping projection. Since embodiment 2 is the same as embodiment 1 in all other respects, the same numerals as in embodiment 1 are accorded to similar parts, and descriptions of the structure, operation and effects thereof are omitted.

A cam groove 42 is formed so as to open out towards the inner and outer faces of an attachment member 41 of a lever 40. Along with this, a supporting member 43 is formed on the external face of the attachment member 41. A stopping projection 44 projects from the supporting member 43 and comprises an arm member 44A that extends along the cam groove 42 and is elastically bendable in the inner-outer direction thereof, and a fitting member 44B which projects from the arm member 44A so as to cut across the cam groove 42 and fit with the fitting groove 24. Moreover, as in embodiment 1, the stopping projection 44 is provided in a location distant from the trace described by a cam pin 12 as it is inserted into the cam groove 42. Further, the opening of the cam groove 42 is set to have the same dimension as the fitting groove 24 in order to prevent collision with the stopping projection 44.

As shown in FIG. 9, the lever 40 is maintained in an initial position by engagement of the fitting member 44B with the edge of the fitting groove 24. From this state, when the male connector 10 is inserted into the hood member 22, the cam pin 12 is inserted into the cam groove 42. Along with this, a pressing member 13 fits with the fitting member 44B and pushes it outwards. When this happens, as shown in FIG. 10, the arm member 44A bends elastically and the fitting member 44B moves and is separated from the fitting groove 24, thereby allowing the lever 40 to pivot. The degree of bending is reduced because the projection 44B engages the pressing member 13 rather than the outer end of the cam pin 12.

Figure 11:
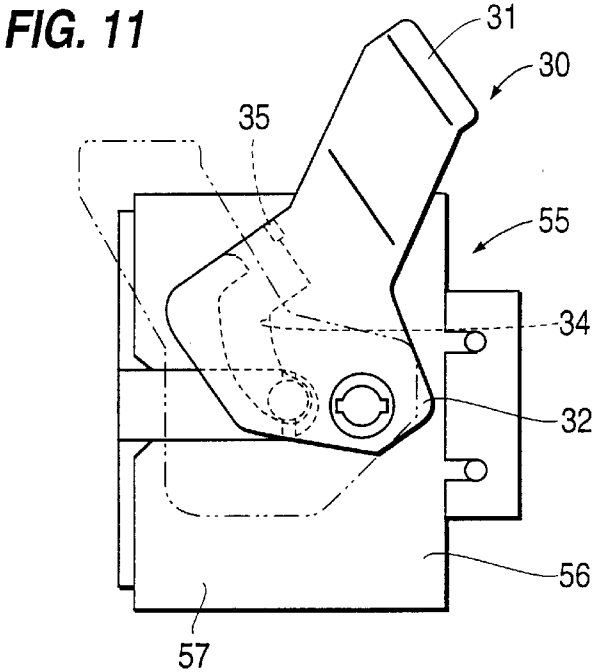
FIG. 11 is a side view of embodiment 3 showing the fitting operation of the connectors.

Next, embodiment 3 of the present invention is described, with reference to FIG. 11.

In this embodiment, the area of the side face of the female connector of embodiment 1 is larger.

Since the side faces of a connector housing 56 and a hood member 57 of the female connector 55 are wide, when a stopping projection 35 rotatively changes position in accompaniment with the rotative operation of a lever 30, the stopping projection 35 describes a rotative trace within the range of the side faces of the female connector 55. If the stopping projection 35 describes a rotative trace that falls outside the range of the side face of the female connector 55, a large resistance is produced due to the elastic bending of the lever 30 when, during a returning operation of the lever 30, the stopping projection 35 passes over the side edge of the female connector 55. By contrast, in the present embodiment, since the stopping projection 35 maintains elastic contact with the side face of the female connector 55 throughout the entire rotating range of the lever 30, there is almost no change in operating resistance, resulting in good operability of the lever 30.

Figure 12:
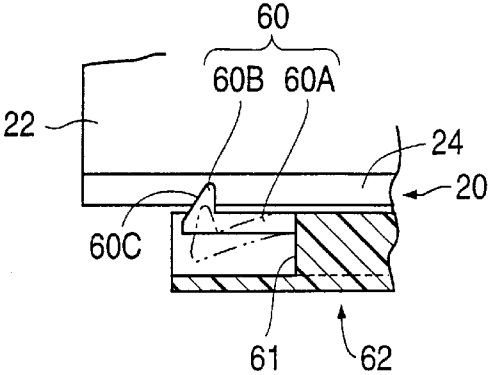
FIG. 12 is a partially enlarged cross-sectional view of embodiment 4 showing a state whereby the stopping projection fits with the fitting groove, thereby preventing the lever from being rotated.

Next, embodiment 4 of the present invention is described, with reference to FIG. 12.

In this embodiment, the configuration of the stopping projection differs from that described in embodiment 1. A stopping projection 60 comprises an arm member 60A which protrudes in a cam groove 61 so as to face a male connector (not shown in FIG. 12), and a fitting member 60B which protrudes inwards from the anterior end of the arm member 60A and fits with a fitting groove 24. The anterior end of the fitting member 60B has a guiding face 60C formed so as to be inclined with respect to the fitting direction of the connectors. As in the case of embodiment 1, the fitting member 60B is located in a position so as to avoid collision with a cam pin (not shown in FIG. 12).

As shown by bold lines in FIG. 12, a lever 62 is maintained in an initial position when the fitting member 60B fits from an exterior side with the fitting groove 24. In this state, when the male connector is fitted into a hood member 22, the cam pin enters the cam groove 61 and in the fitting groove 24 a guiding face of a pressing member (not shown) fits with the guiding face 60C of the stopping projection 60. The fitting member 60B is thus pushed out. When this happens, as shown by broken lines in FIG. 12, the arm member 60A bends elastically and the fitting member 60B moves and separates from the fitting groove 24, making the lever 62 pivotable.

Moreover, in the present embodiment, since the stopping projection 60 is elastically bendable, there is no possibility of the lever 62 changing shape itself.

Figure 13:
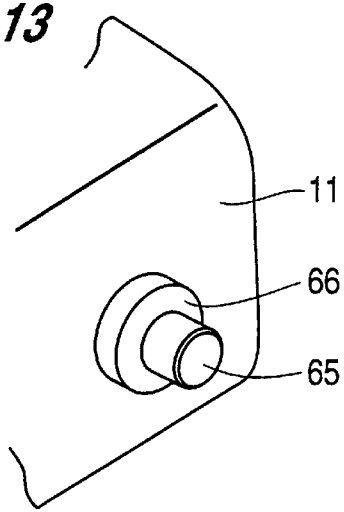
FIG. 13 is a partially enlarged diagonal view of embodiment 5 showing the shape of the cam pin and of the stopping projection.

Next, embodiment 5 of the present invention is described, with reference to FIG. 13. In this embodiment, only the configurations of the cam pin and the pressing member are shown. A cam pin 65 and a pressing member 66 are formed so as to protrude in a unified manner from a connector housing 11. The pressing member 66 is formed so as to project from the connector housing 11 and has a cylindrical shape, the diameter thereof being greater than that of a cam groove (not shown in FIG. 13), and the height thereof being low enough so that it does not enter the cam groove. Further, the cam pin 65 coaxially projects from the protruding end face of the pressing member 66, the cam pin 65 forming a cylindrical shape with a smaller diameter and being coaxial with respect to the pressing member 66.

Moreover, a stopping projection (not shown in FIG. 13) is located so as to correspond with the pressing member 66 projecting outwards from the cam pin 65. Consequently, the stopping projection does not collide with the cam pin 65 and is moved by the pressing member 66 so that the lever is released from its locked position.

Figure 14:
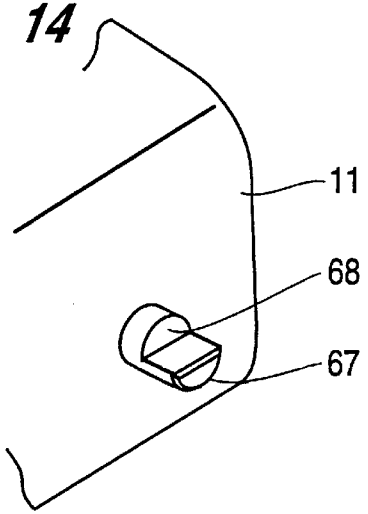
FIG. 14 is a partially enlarged diagonal view of embodiment 6 showing the shape of the cam pin and of the stopping projection.
Figure 18:
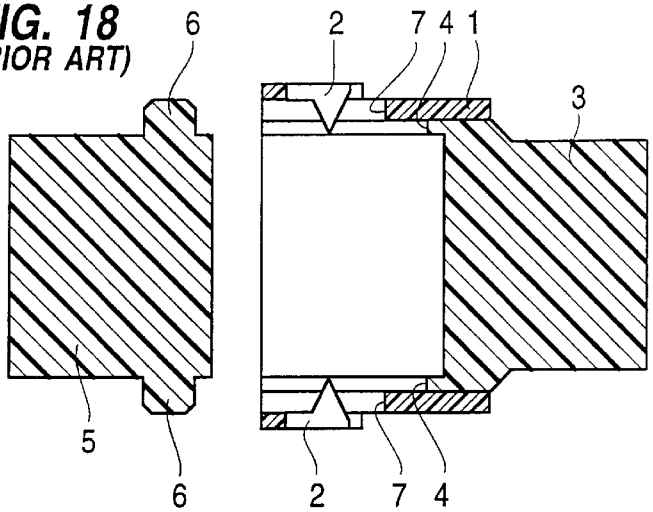
FIG. 18 (PRIOR ART)
FIG. 18 is a cross-sectional view of the prior art example showing a state whereby the stopping projection fits in the fitting groove, thereby preventing the lever from being rotated.
Figure 19:
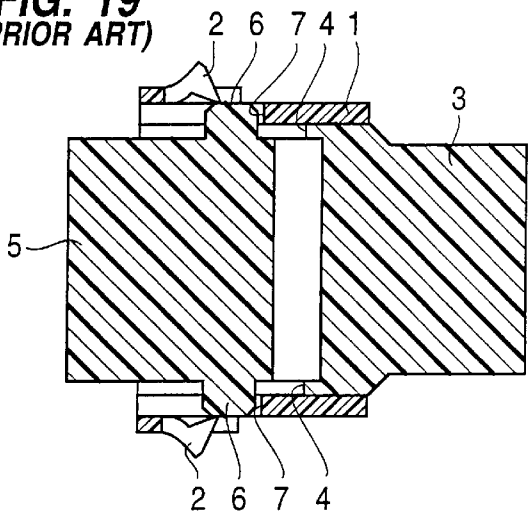
FIG. 19 (PRIOR ART)
FIG. 19 is a cross-sectional view of the prior art example showing a state whereby the stopping projection separates, thereby allowing the lever to be rotated again.
Figure 17:
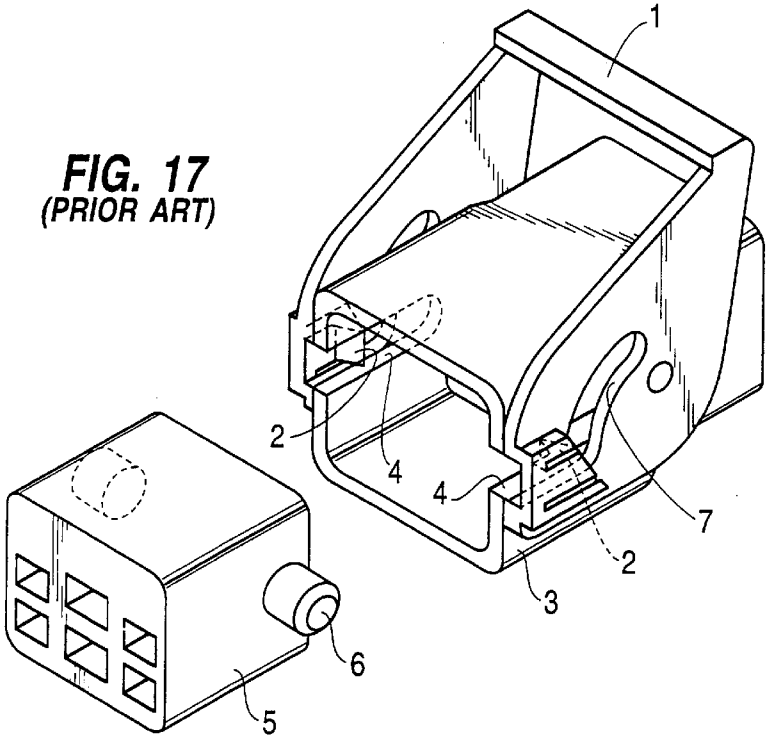
FIG. 17 (PRIOR ART)
FIG. 17 is a diagonal view of the prior art example showing a state whereby the connector housings are separated.

Next, embodiment 6 of the present invention is described, with reference to FIG. 14. In this embodiment, only the configurations of the cam pin and the pressing member are shown. A cylindrically shaped pressing member 68, having a height that is low enough so that it does not enter a cam groove (not shown in FIG. 14), projects from a connector housing 11. A semi-cylindrical cam pin 67 projects in a unified manner coaxially from the protruding end face of the pressing member 68, the cam pin 67 being concentric with and having the same diameter as the pressing member 68.

The flat side face of the cam pin 67 is parallel to the direction of insertion of the cam pin 67 into the cam groove, and the stopping projection (not shown in FIG. 14) is positioned in the location corresponding to the unformed semi-cylinder of the cam pin 67 on the pressing member 68. Consequently, the stopping projection does not collide with the cam pin 67, and is moved by the pressing member 68 in the direction of release of the locked state the lever.

Figure 15:
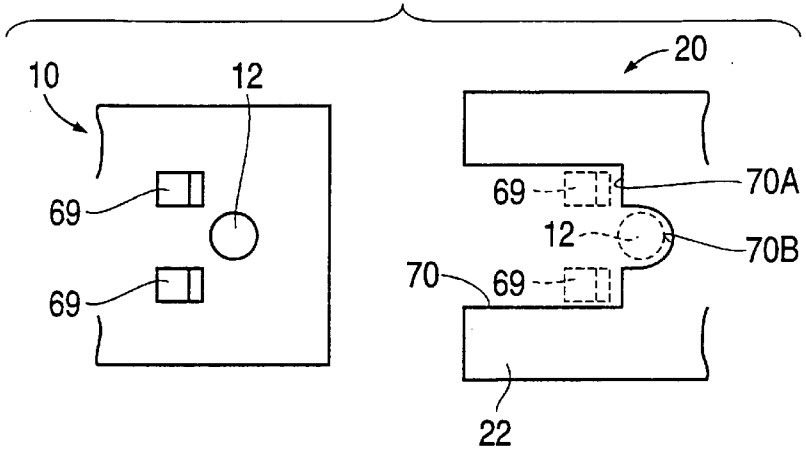
FIG. 15 is a partial side view of embodiment 7 showing the location of he cam pin and the pressing member and the shape of the fitting groove.

Next embodiment 7 of the present invention is described, with reference to FIG. 15.

A male connector 10 has one cam pin 12 and two pressing members 69 formed in different locations. The two pressing members 69 are located posteriorly (towards the left in FIG. 15) with respect to the cam pin 12. The pressing members 69 are located so as to be positioned on both sides of the cam pin 12 in a direction (the up-down direction in FIG. 15) that is perpendicular to the fitting direction. The pressing members 69 fit with stopping projections (not shown in FIG. 15) provided in locations distant from the trace described by the cam pin 12 during its movement, thereby moving the stopping projections in the direction of release of the rotation lock on the lever.

The female connector 20 has a fitting groove 70 into which the cam pin 12 and the pressing members 69 are inserted. The width of the fitting groove 70 is set to be the minimum possible so that a large space is not left by the pressing member 69 with respect to the edge of the fitting groove 70. Moreover, the inner end of the fitting groove 70 has a linear member 70A corresponding to each pressing member 69, and a concave member 70B formed by cutting into the linear member 70A to allow only the cam pin 12 to enter therein. Accordingly, the linear member 70A and the concave member 70B correspond respectively to the positions of the pressing members 69 and the cam pin 12 when the connectors 10 and 20 are in a fully fitted position. In the present embodiment, since the cutting away of the fitting groove 70 is reduced to the minimum amount necessary, the reduction in strength of the hood member 22 can be controlled.

Figure 16:
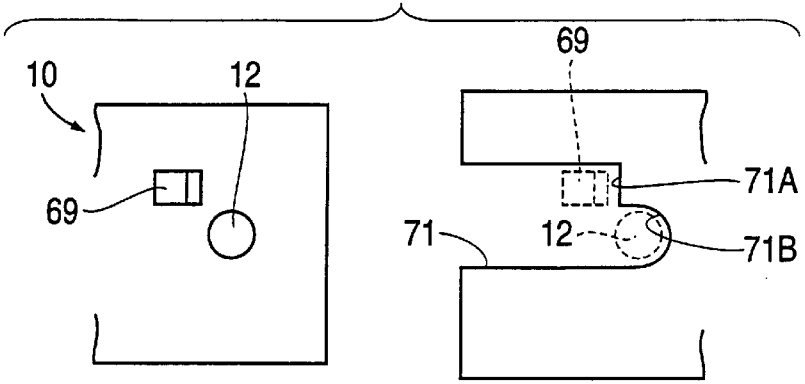
FIG. 16 is a partial side view of embodiment 8 showing the location of the cam pin and the pressing member and the shape of the fitting groove.

Finally, embodiment 8 of the present invention is described, with reference to FIG. 16.

In this embodiment, the configuration is such that one pressing member 69 (the lower one in FIG. 15) of embodiment 7 is omitted. Corresponding to this, the amount of cutting away required of a fitting groove 71 is reduced to a greater degree than in embodiment 7, the reduction being effected to the extent of the space that would be required for entry by the omitted pressing member 69. Moreover, as in the case of embodiment 8, the inner end of a fitting groove 71 has a linear member 71A which corresponds to a pressing member 69, and a concave member 71B into which only a cam pin 12 can enter.

Moreover, on the opposite side face which is not shown in the diagram, the following locations are symmetrical in an up-down direction: the location of the pressing member 69 with respect to the cam pin 12, the shape of the fitting groove 71, and the location of a stopping projection (not shown) to be fitted to the fitting groove 71. Consequently, the present embodiment reduces the cutting away of the fitting groove 71 to the minimum amount necessary, and the pivoting of a lever (not shown) in the forwards and reverse directions can be controlled.

The present invention is not limited to the embodiments described above with the aid of figures. For example, the possibilities described below also lie within the technical range of the present invention. Moreover, the present invention may be embodied in various ways other than those described below without deviating from the scope thereof.

(1) The present invention can also be applied to a lever-type connector that puts a rotation lock on a lever by making a stopping projection fit into a cam groove from an external face, the cam groove opening out both into the inner and outer faces of the lever, and the stopping projection being made to project from the connector housing in an arm-like shape.

(2) Although in embodiment 4 it is arranged so that an elastically bendable stopping projection is formed within a cam groove and the rotation lock on the lever is effected by making this stopping projection fit into the fitting groove from an exterior face, it is equally acceptable to reverse this and to form the elastically bendable stopping projection in the fitting groove and making this fit with the cam groove from the interior face side.

The connector housings incorporate electrical terminals of the usual kind, and can be terminal portions of a wiring harness or be formed integrally with a piece of electrical equipment.

We claim:

1. A lever-type electrical connector assembly comprising a male housing and a female housing adapted to fit the male housing, opposite cam pins protruding a first distance from one of said housings and a lever pivotable on the other of said housings, the lever defining opposite cam grooves for engagement with said cam pins whereby pivoting of said lever from an initial to a final position causes said cam pins to move along said grooves, thereby causing said housings to be drawn together in use from an initially coupled condition to a fully coupled condition, a stopping projection protruding a second distance from one of said other of said housings and said lever to restrict pivoting movement of said lever from the initial position, said second distance being less than said first distance, said stopping projection being spaced from the path of movement of said cam pins in use, and a pressing member being provided on said one of said housings, the pressing member being engageable with said stopping projection in the initially coupled condition of said housings to urge said projection to a condition whereby pivoting of said lever is not restricted.

2. A connector assembly according to claim 1 wherein the pressing member has a guide face provided for camming engagement with the stopping projection, such that on camming engagement of the guide face with the stopping projection the stopping projection is urged to a condition whereby pivoting of said lever is not restricted.

3. A connector assembly according to claim 1 wherein the stopping projection is formed on the lever and fitting grooves are defined in said other of said housings, the fitting grooves being suitable to accommodate the cam pins of said one of said housings, wherein in the initial position the stopping projection is engageable in one of the fitting grooves to restrict pivotal movement of said lever, and the pressing member is engageable in said one fitting groove with the stopping projection to urge the stopping projection out of engagement in the fitting groove.

4. A connector assembly according to claim 3 wherein the pressing member is substantially the same width as said one of the fitting grooves, and the corresponding cam pin is substantially narrower than said fitting groove.

5. A connector assembly according to claim 3 wherein the pressing member is flush with the exterior of said other of said housings when the assembly is in an assembled state.

6. A connector assembly according to claim 4 wherein the pressing member is flush with the exterior of said other of said housings when the assembly is in an assembled state.

7. A connector assembly according to claim 2 wherein the stopping projection is formed on the lever and fitting grooves are defined in said other of said housings, the fitting grooves being suitable to accommodate the cam pins of said one of said housings, wherein in the initial position the stopping projection is engageable in one of the fitting grooves to restrict pivotal movement of said lever, and the pressing member is engageable in said one fitting groove with the stopping projection to urge the stopping projection out of engagement in the fitting groove.

8. A connector assembly according to claim 7 wherein the pressing member is substantially the same width as said one of the fitting grooves, and the corresponding cam pin is substantially narrower than said fitting groove.

9. A connector assembly according to claim 7 wherein the pressing member is flush with the exterior of said other of said housings when the assembly is in an assembled state.

10. A connector assembly according to claim 8 wherein the pressing member is flush with the exterior of said other of said housings when the assembly is in an assembled state.

11. A connector assembly according to claim 1 wherein the pressing member projects from said housing to a lesser extent than the cam pins.

12. A connector assembly according to claim 4 wherein the pressing member projects from said housing to a lesser extent than the cam pins.

13. A connector assembly according to claim 10 wherein the pressing member projects from said housing to a lesser extent than the cam pins.

14. A connector assembly according to claim 1 wherein the stopping projection is located in the lever sufficiently close to the pivot axis of the lever as to be enclosed between the lever and said other of said housings throughout the sweep of the lever relative said housing.

15. A connector assembly according to claim 3 wherein the stopping projection is located in the lever sufficiently close to the pivot axis of the lever as to be enclosed between the lever and said other of said housings throughout the sweep of the lever relative said housing.

16. A connector assembly according to claim 13 wherein the stopping projection is located in the lever sufficiently close to the pivot axis of the lever as to be enclosed between the lever and said other of said housings throughout the sweep of the lever relative said housing.

17. A connector assembly according to claim 1 wherein the stopping projection is a lug projecting from the internal surface of the lever towards said other of said housings, the lever being resilient.

18. A connector assembly according to claim 15 wherein the stopping projection is a lug projecting from the internal surface of the lever towards said other of said housings, the lever being resilient.

19. A connector assembly according to claim 1 wherein the stopping projection comprises a resilient arm of the lever, the resilient arm having a portion projecting inwardly towards said other of said housings.

20. A connector assembly according to claim 15 wherein the stopping projection comprises a resilient arm of the lever, the resilient arm having a portion projecting inwardly towards said other of said housings.

* * * * *